United States Patent [19]

Bertolotti

[11] Patent Number: 4,928,454

[45] Date of Patent: May 29, 1990

[54] PROCESS FOR WRAPPING RIBBON TYPE METAL COILS

[75] Inventor: Luigi Bertolotti, S. Giovanni Valdarno, Italy

[73] Assignees: Bertolotti S.p.A., Genoa; Nuova Italsider S.p.A., Valdarno, both of Italy

[21] Appl. No.: 267,171

[22] Filed: Nov. 4, 1988

Related U.S. Application Data

[60] Division of Ser. No. 124,415, Nov. 23, 1987, Pat. No. 4,793,485, which is a continuation of Ser. No. 836,317, Mar. 5, 1986, abandoned.

[30] Foreign Application Priority Data

Mar. 15, 1985 [IT] Italy ..... 9362 A/85
Dec. 20, 1985 [IT] Italy ..... 9549 A/85

[51] Int. Cl.[5] ..... B65B 25/24
[52] U.S. Cl. ..... 53/409
[58] Field of Search ..... 53/409, 204; 206/397, 206/398, 401, 402, 403, 410, 414, 415, 416

[56] References Cited

U.S. PATENT DOCUMENTS

| | | | |
|---|---|---|---|
| 298,562 | 5/1884 | Dunnell | 206/414 |
| 1,178,173 | 4/1916 | Misegades | 206/414 |
| 1,772,850 | 8/1930 | Wheldon | 206/414 |
| 1,808,018 | 6/1931 | Charles | 206/401 |
| 1,898,857 | 2/1933 | Theiss | 206/410 |
| 2,335,766 | 11/1943 | Kinloch | 206/403 |
| 2,856,141 | 12/1974 | Reed | 53/409 X |
| 3,921,803 | 11/1975 | Reed | 53/204 X |

FOREIGN PATENT DOCUMENTS

| | | | |
|---|---|---|---|
| 243453 | 11/1925 | United Kingdom | 206/414 |

*Primary Examiner*—John Sipos
*Attorney, Agent, or Firm*—Emmanuel J. Lobato; Robert E. Burns

[57] ABSTRACT

The wrapping includes two front end discoidal lids with cylindrical perimetral covers, suitable to surround the coil; each of the two lids is made up of at least two parts (21, 23; 25, 27) defined by radial planes, as two half-covers, which are assembled one after the other, each resting on the top part of the coil B, and making the coil itself resting on rollers 35 rotate; the two lids are made so that they overlap when they are assembled on the coil axially opposite to one another.

4 Claims, 2 Drawing Sheets

Fig.7
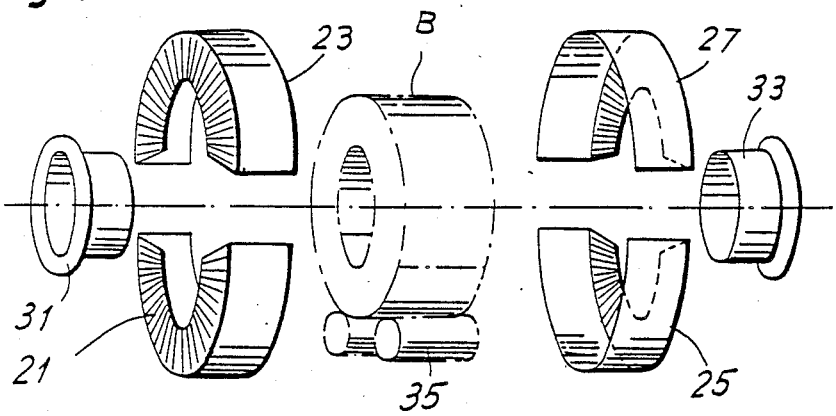
Fig.8
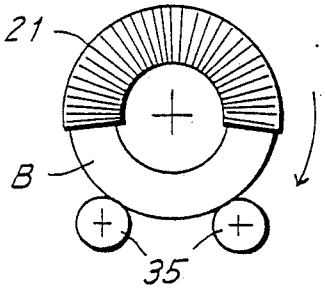
Fig.9
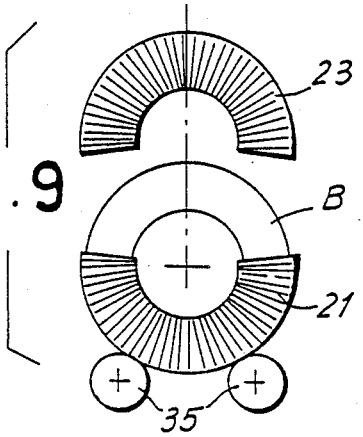
Fig.11
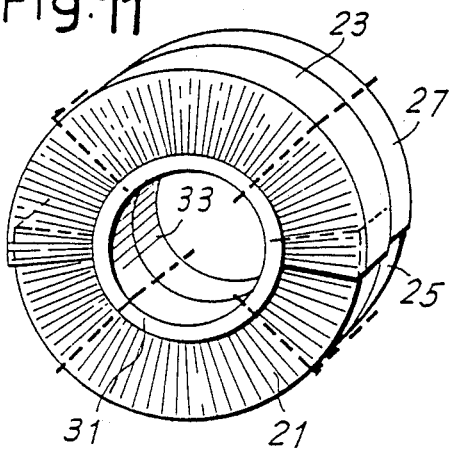
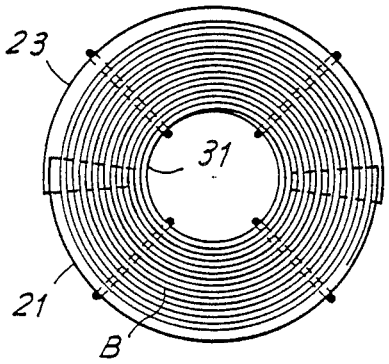
Fig.10

PROCESS FOR WRAPPING RIBBON TYPE METAL COILS

This is a division of application Ser. No. 124,415 filed Nov. 23, 1987, now U.S. Pat. No. 4,793,485, which is a continuation of Ser. No. 836,317 filed 3-5-86 and now abandoned.

BACKGROUND OF THE INVENTION

Wrappers of coils, which are presently hand-made at a high cost, serve to protect the contents from the action of atmospheric agents and from external blows caused by the means of lifting and transportation.

BRIEF SUMMARY OF THE INVENTION

The scope of the invention is to obtain a low-cost metal wrapper, which may be machine-made and easily applied.

The invention is based on the aim of wrapping the coil in two front end half-lids of a suitable diameter, made out of metal obtained from suitably machined rejected coils, and the edges of which are overlapped so that the dimensions need not necessarily be precise but are able to guarantee an acceptable degree of water-tightness.

The scope of the invention is therefore a wrapper for coils, made of metal sheeting, in order to protect them for blows and from atmospheric agents, using also plastic-coated paper or other materials, and in which the wrapper is formed by two disc-shaped end lids with cylindrical covers around the perimeter, to surround the coil. The two lids are formed as open rings, in one or more points, to simplify assembly. The two perimetral covers overlap one another, so as to cover completely the outermost turn of the coil.

Each of the two lids has a central hole in the disc-shaped surface, and flanged half-sleeves interact with these holes to complete the end covering of the coil and protect its innermost turn.

The disc-shaped front of each lid is formed with radial folds, or pleats, of progressively increasing depths towards the centre.

Each of the two lids may be formed by at least two parts defined by radial planes, which complete the lid on assembly.

Each lid may be formed by two half-lids, each developed over a little more than 180 degrees.

Another scope of the invention is a procedure for forming a wrapper of the type described above, according to which each lid or part of a lid is formed by a ribbon-shaped strip folded at a right angle and with the disc-shaped front end obtained by making pleats in one of the two "wings" of the right-angle, while the other forms the cover.

More in detail, the procedure may provide that strips of a suitable length be cut from the ribbon-shaped metal sheeting of a rejected coil; that each piece be bent longitudinally to form a right-angle, with one wing slightly wider than half the width of the original coil; and that the other wing by subjected to deformation with the formation of consecutive triangular folds, and each fold having a depth increasing gradually from the longitudinal fold, thus obtaining the progressive cylindical curving of the greater wing, and finally the wrapper covering the turns, with partial overlapping of the edges.

A procedure for forming a wrapper with the lids in at least two parts may provide that two corresponding first parts of lids be placed on the coil which is conveyed on rollers supporting it and allowing it to rotate in the known fashion; and that the coil with said first two lid parts be rotated so that said two lid parts come to be underneath between the supporting rollers and the coil, after which more parts of the lid are positioned on the coil.

Two open half-sleeves are also formed, having flanges which develop in such a way that on assembly the flange covers the internal circular edge formed by the folds which constitute the front face of the lid.

With the procedure under reference, the plastic coated paper may be coupled to the strip of metal and worked together with the latter. Locally foaming plastic sealants may also be used.

BRIEF DESCRIPTION Of THE DRAWINGS

FIG. 7 is an exploded view of the components of the wrapper, according to another type of embodiment.

FIGS. 8 and 9 illustrate summarily two phases of a procedure for composing the wrapper around the coil.

FIGS. 10 and 11 are axial views and in perspective.

DETAILED DESCRIPTION OF THE PREFERRED EMBODIMENT

Figure 1:
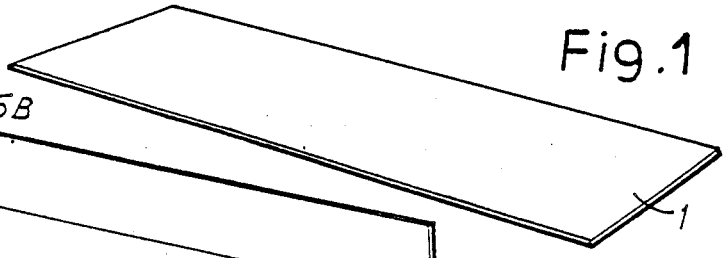
FIGS. 1, 2 and 3 show in perspective various stages of processing of a metal sheet used to form one of the lids.
Figure 2:
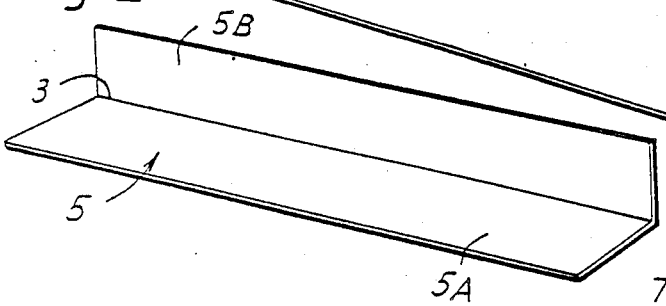
Figure 3:
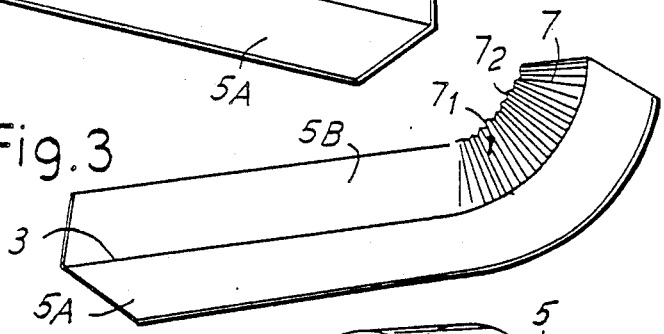
Figure 4:
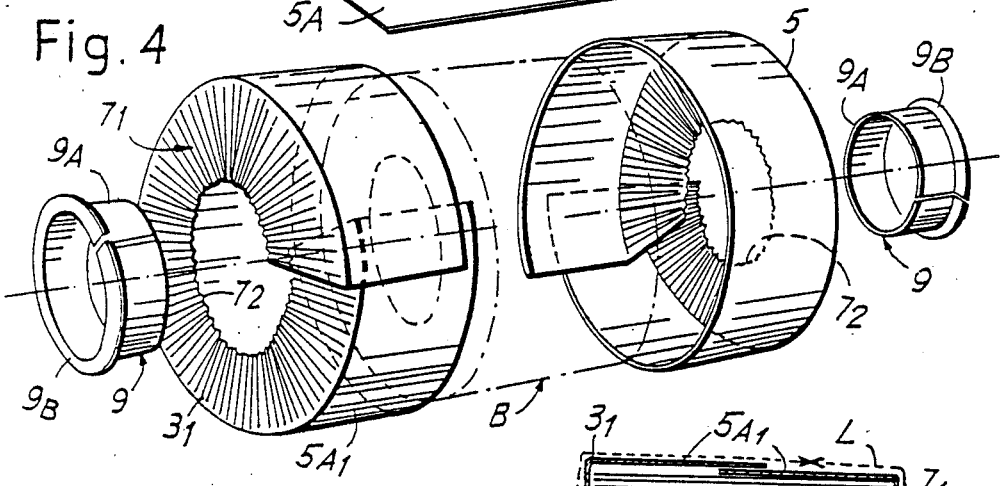
FIG. 4 is an exploded view, shown in perspective and with a partial deformation, of the components of a wrapper for a ribbon-type metal coil.

Starting from a ribbon type material—possibly and preferably consisting of lengths of rejected metal sheeting from a lot of coils to be wrapped—rectangular elements 1 are made (FIG. 1), the longest side of which is slightly in excess of the outer circumference of the transverse cross-section of coil B to be wrapped. The shorter side may correspond to the width of the strip forming the coil to be wrapped. Element 1 is folded in three lengthwise as shown in FIG. 2, to obtain a semi-finished piece 5; wing 5A measures little more than half the width of the strip forming the coil, while wing 5B measures about the same or slightly less than the radial thickness of coil B to be packed, that is to say the difference between the outer radius and the inner radius of the coil as it is normally prepared for shipment. Wing 5B is pleated with folds perpendicular to the line of folding 3 and practically with triangular pleats, so as to reduce the length of element 5 along the outer longitudinal edge which defines wing 5B; with the deformation in triangular pleats 7 of wing 5B; progressive curving of the folding line 3 is obtained, and the deformation in a cylindrical direction of wing 5A, consequent to the progressive working of the material of wing 5B with the folds described.

Once the pleating operation with folds 7 has been completed, a lid is obtained having an approximately disc-like shape, it being formed by a little over one turn; the deformations of wing 5B will be such as to obtain this result, which corresponds to a sizing of the cover such as to allow it to be inserted onto coil B; the lid consists of the front end $7_1$, a substantially circumferential sharp edge $3_1$ and a substantially cylindrical cover $5A_1$, with the edges overlapping slightly. The lid is open, which makes it easier to insert on the suspended coil.

Figure 5:
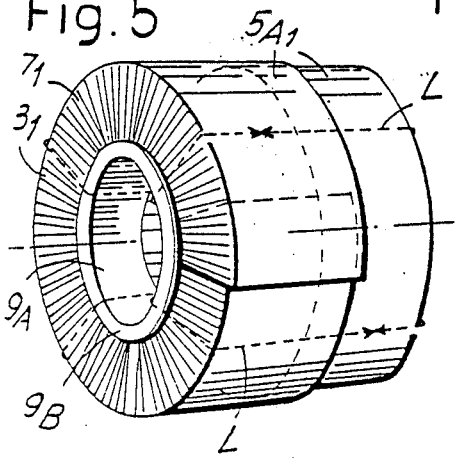
FIG. 5 shows a complete wrapper, in perspective.
Figure 6:
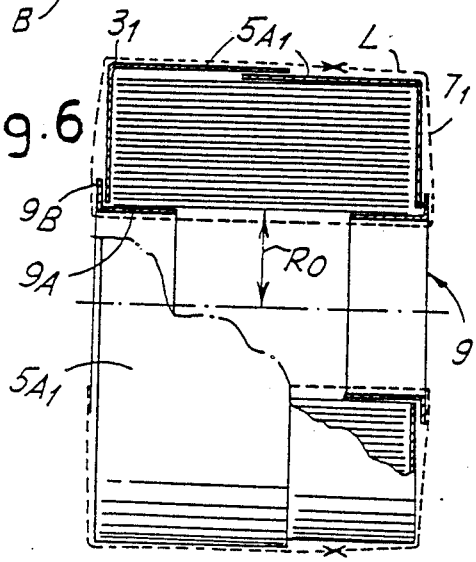
FIG. 6 is a side view and partial cross-section of this wrapper.

With two lids as described above and placed opposite each other, a coil B may be packed having the two covers $5A_1$ sized to that they overlap slightly one another, as shown in detail in FIGS. 5 and 6, so as to enclose completely the coil B; the front ends $7_1$ cover the ends of the coil almost up to the internal opening radius Ro. To complete the packing and form a wrapper able to protect even the innermost parts of the coil, two open half-sleeves 9 are used. Each of these has a cylindrical cover 9A of a radius slightly smaller than radius Ro, and an external flange on one end. The radial dimension of the outside perimeter of the flange is greater than the radial dimension of the inner edge $7_2$ of the pleated discoidal front end $7_1$. The two half-sleeves 9 are inserted into the central holes of the pleated discoidal front ends $7_1$ so that the covers 9 penetrating into the central opening in the coil B and the flanges 9B reach and exceed the inner edge $7_2$ of the front ends $7_1$.

The wrapper is thus complete and may be secured by means of inner and outer fastenings.

In order to complete the wrapper, the formation of an internal protective plastic-coated paper wrapper may be provided, created by coupling the paper to the metal so that assembly is achieved in one sole operation.

The use of protective materials in foam plastic may also be provided, even applied so that they foam locally, after assembly.

The size of coils is variable, and has to be taken into account when making the wrappers. Standard measurements are in general : diameter of central hole 610 to 740 mm, outer diameter 900 to 2000 mm, width 600 to 1500 mm, weight 500 to 20,000 kgs.

The two-lidded wrapper may be made out of sheets 1 about 200 mms longer than the circumference of the coil, and wide enough to form by means of the central lengthwise fold 3 a right angle with the side 5B equal to the height of the rim of the coil and the other 5A greater than half the width of the coil.

The metal folded at a right angle lengthwise may be inserted into a special pleating machine able, by a die process, to produce along one side of the right angle the triangular folds 7 which reduce the length of the metal along its edge and create the circular rim, while the other side becomes curved and forms the cover for the circumference of the coil. The triangular folds 7 on the rim are sized in such a way that side 5B of the right-angle which will become the circumference $7_2$ of the central hole is reduced in length as compared to the sharp edge 3 of the right angle itself, with a ratio such that the two required circumferences are obtained, that is to say the circumference of the hole $7_1$ and the outside cicumference $3_1$ of the coil. The depth and the frequency of the folds, therefore, are the parameters to be taken into acocunt in order to obtain the outside diameter and the diameter of the hole.

The wrapper formed by the two lids is completed in the hole by means of the two half-sleeves 9 inserted as packings into each metal lid. These half-sleeves have a raised edge which covers the sharp edge of the hole $7_2$, protecting it.

While at the moment, as far as sealing is concerned, the coil to be packed in a metal wrapper is first wrapped in plastic-coated paper, with considerable practical difficulties, using the metal wrapper according to this invention it is possible to eliminate manual application of the paper by gluing the paper itself to the sheet of metal with a few spots of adhesive before working it, and pleating the metal rim and the paper rim at the same time. The paper applied is of a larger size than the sheet of metal, and the excess part will serve for the overlapping of the two half-lids and for folding into the hold of the coil, In some cases, an expedient to keep in mind is to obtain in the hole in the metal cover an outlet for any rain water or other water to be found at the bottom of the holds of a ship, and which might enter through the joints. In order to avoid this, it is possible, when forming the pleated circular rim, to make a cut at the root of each fold for a small length near to the outer circumference. These cuts, drawn outwards, greatly limit the entry of rain water, while they make it easier for it to run out.

The wrapping described above offers the possibility of being machine made by suitable machines, as well as being very resistant to blows, in particular due to the fact that the two circular rims on the ends are reinforced by the dense pleating, thus protecting the most vulnerable parts of the coil.

The continuity of the covering constituted by the two lids offers no catches for the chains or cables used for transportation, and in addition coils packed in this way have a clearly businesslike appearance.

According to FIGS. 7 and 11, a wrapper for a coil of sheet metal, for protecting against blows and atmospheric agents and with an internal lining of plastic-coated paper or other material is formed (see in particular FIG. 7) by four parts, 21, 23, 25 and 27. The two parts 21 and 23 form a lid which is made to cover over half the cylindrical surface of the coil, and one of the ends, that is to say one of the circular faces; the two parts 25 and 27 ae used to form the other lid to complete the protection, which is further formed by two half-sleeves 31 and 44; these are flanged, as in the previous case, in order to protect the innermost turn of the coil in correspondence with the through hole formed by the coil when it is rolled. The half-sleeves 31 and 33 may be closed or open, but their assembly is particularly easy as they are relatively light and can be inserted into the coil while it rests on a means of support and is already completely wrapped in parts 21, 23, 25 and 27.

As in the preceeding case, said parts 21, 23, 25 and 27 may be made with a covering including a partial cylindrical wall and an end portion formed by radial pleats in the metal sheeting of which the whole wrapper is made up.

Each of the two half-lids may be made up of two parts such as 21 and 33, 25 ans 27 respectively, which develop each for a little over 180 degrees, so that on assembly the two parts overlap slightly, and ensure the continuity of the protection. It may not be excluded, on the other hand, that each lid may be made up of more than two parts, of the same or different sizes from one another, but forming all together a cylindrical lid, and with the front parts pleated in order to protect the front ends formed by the edges of the turns of metal of the coil.

The configuration of a lid in two or more parts may be advantageous above all for the handling required to assemble the wrapper on the coil, making the operations easier than those necessary for forming the wrapping with the system described in the preceding case.

With particular reference to FIGS. 8 and 9, it can be seen that the coil B to be fitted with a wrapper may —is usually the case—rest on two rollers 35, which make it possible to support the coil, formed and possibly fastened circumferentially, and to manoevre it by rotation. On the rollers 35, a coil may be transferred by means of a pilgrim system or another suitable system, by which a coil is transferred to various stations in succession for the various stages of packing. With the packing system as per this invention, the two parts such as 21 and 25—when for example a system with four parts such as 21, 23, 25 and 27 is used—are brough to rest on the back of the coil, that is to say on the upper part of the coil resting on the rollers 35, as shown in FIG. 7. Immediately afterwards, and very easily, it is possible to rotate the coil and the parts of the wrapper such as 21 and 25 as per arrow f10 by about 180 degrees, so that these two parts 21 and 25 come to be on the lower part of the coil resting on the rollers 35. At this point (see FIG. 9), the other two parts of the wrapper, such as 23 and 27, are positioned, so as to complete the wrapper itself, which is shown in FIGS. 10 and 11. From these figures it may be seen that the wrapping is complete, as the two parts of a lid made up of parts 21 and 23 may be slightly overlapped, while the two lids made up of the pairs of parts 21 and 23 and 25 and 27 respectively completely cover the cylindrical body of the outermost turn of the coil B, since the width of the coil is smaller than the sum of the widths of the cylindrical covers formed by parts 21, 23, 25 and 27 of the wrapper. After having completed the outer wrapper, the half-sleeves 31 and 33 are easily inserted, and the finished package is ready for further processing. Such as fastening or further handling and shifting for shipment and so on.

What I claim is:

1. A process of wrapping a coil of strip metal which comprises the steps of:

cutting two strips of metal having the same width as said strip metal and a combined length slightly greater than two times the outer circumference of said coil, bending each of said strips at right angles about a longitudinal fold line to form first and second longitudinally extending wings disposed at right angles to one another, said first wing having a width slightly greater than half the width of said coil, forming in said second wing a series of triangular pleats with the apexes of said pleats at said fold line to reduce the length of a free edge of said second wing while bending said first wing into an arc having a radius substantially equal to the radius of the outer periphery of said coil, assembling said bent and pleated strips on said coil with said pleated second wing of one strip overlying one end of said coil said pleated second wing of another strip overlying an opposite end of said coil, with said arcuately curved first wings of said strips overlapping one another and covering the outer periphery of said coil, and said coil being annular with a cental hole having an inner periphery, and said second wings of said strips having a width which is approximately equal to the radial distance between the inner periphery and the outer periphery of said coil.

2. A process of wrapping a coil of strip metal according to claim 1, in which flanged split sleeves are fitted into opposite ends of said central hole of said coil after said bent and pleated strips are applied to said coil.

3. A process of wrapping a coil of strip metal according to claim 1, in which said two strips of metal having the same width as the strip metal of said coil are cut from rejected lengths of said strip metal similar to that on said coil.

4. A process of wrapping a coil of strip metal which comprises the steps of:

cutting four strips of metal having the same width as said strip metal and a combined length slightly greater than two times the outer circumference of said coil, bending each of said strips at right angles about a longitudinal fold line to form first and second longitudinally extending wings disposed at right angles to one another, said first wing having a width slightly greater than half the width of said coil, forming in said second wing a series of triangular pleats with the apexes of said pleats at said fold line to reduce the length of a free edge of said second wing while bending said first wing into an arc having a radius substantially equal to the radius of the outer periphery of said coil, assembling said bent and pleated strips on said coil with said pleated second wing of one strip overlying one end of said coil, said pleated second wing of another strip overlying an opposite end of said coil, with said arcurately curved first wings of said strips overlapping one another and covering the outer periphery of said coil, and said coil being annular with a central hole having an inner periphery, and said second wings of said strips having a width which is approximately equal to the radial distance between the inner periphery and the outer periphery of said coil, said bent and pleated strips being assembled on said coil by applying two of said strips, after bending and pleating, to opposite ends of an upper side of said coil while said coil is supported with its axis horizontal and thereafter rotating said coil approximately 180° about its axis and applying the remaining two strips, after bending and pleating, to the side of said coil which is the upper side after said rotation.

* * * * *